US005323687A

United States Patent [19]

Zenker et al.

[11] Patent Number: 5,323,687

[45] Date of Patent: Jun. 28, 1994

[54] HYDRAULIC CIRCUIT

[75] Inventors: Siegfried Zenker, Kirchseeon, Fed. Rep. of Germany; Helge Jorgensen, Sydals; Thorkild Christensen, Sonderborg, both of Denmark

[73] Assignee: Danfors A/S, Nordborg, Denmark

[21] Appl. No.: 967,679

[22] Filed: Oct. 23, 1992

[30] Foreign Application Priority Data

Oct. 28, 1991 [DK] Denmark ..... 91.01788

[51] Int. Cl.[5] ..... F15B 11/08

[52] U.S. Cl. ..... 91/449; 91/508; 60/420

[58] Field of Search ..... 91/525, 526, 528, 530, 91/531, 449, 450, 508, 518; 60/420, 422, 426, 445, 452

[56] References Cited

U.S. PATENT DOCUMENTS

| | | | |
|---|---|---|---|
| 3,922,954 | 12/1975 | Gustafsson et al. | 91/525 X |
| 3,976,097 | 8/1976 | Brakel | 91/518 X |
| 3,982,469 | 9/1976 | Bianghetta | 91/518 X |
| 4,179,981 | 12/1979 | Yeou | 91/531 X |
| 4,391,181 | 7/1983 | Weirich et al. | 91/518 X |
| 4,825,748 | 5/1989 | Sheng | 91/528 X |
| 5,138,837 | 8/1992 | Obertrifter et al. | 60/426 |

FOREIGN PATENT DOCUMENTS 8100742 3/1981 PCT Int'l Appl. .

*Primary Examiner*—Edward K. Look
*Assistant Examiner*—Hoang Nguyen
*Attorney, Agent, or Firm*—Wayne B. Easton

[57] ABSTRACT

A hydraulic circuit for a backhoe loader having two double-acting cylinders for the arm and bucket of the loader and respective directional valves for the cylinders. There are heavy demands on the oil pump of the system when the two cylinders are moved simultaneously from one extreme position to another which requires substantially two whole cylinder volumes of oil. The cylinders are arranged in parallel relative to the pump. A first source of pressure medium displaced from one cylinder is used to perform work in the other cylinder and the other cylinder is also supplied with a second source of pressure medium directly from a pump. The line section through which the first source of pressure medium is supplied is shunted to a tank by valving apparatus upon a predetermined pressure being reached to freely accommodate the simultaneous movements of the cylinders.

7 Claims, 4 Drawing Sheets

HYDRAULIC CIRCUIT

Figure 1:
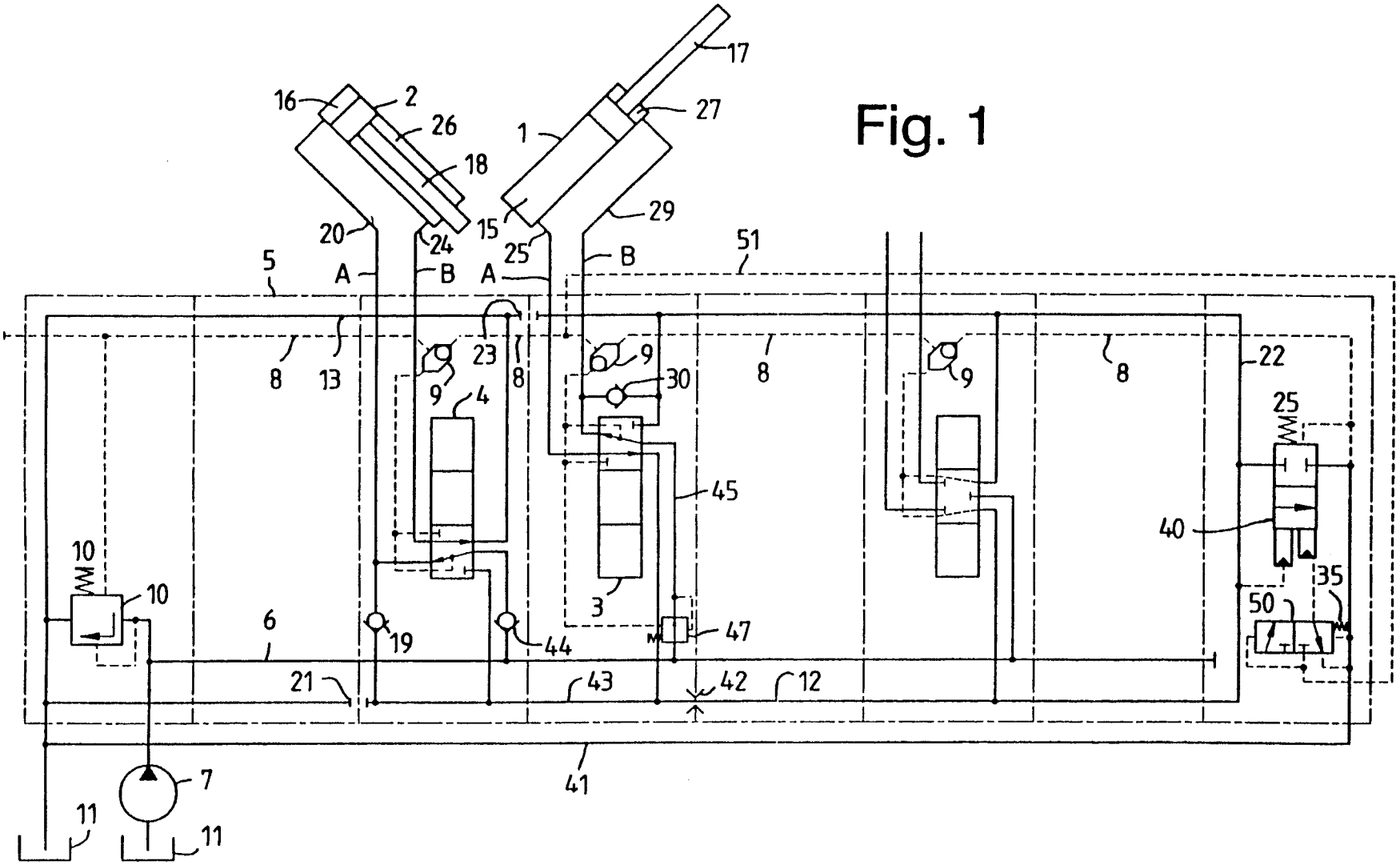

The present invention relates to a hydraulic circuit with at least two double-acting cylinders. A typical example of such a circuit is found on a backhoe loader, where the first cylinder swings an arm, which carries a digging bucket, up and down. Another cylinder serves to tilt the digging bucket downwards when it shall be emptied, and return it to its horizontal position, which is the working position.

The bucket of a backhoe loader is normally emptied with the arm in its lifted position. After the emptying the digging bucket is tilted downwards. The digging position must be reassumed as quickly as possible, where the arm is lowered and the bucket tilted upwards. Often the transition to pressing the arm into the soil will be made immediately. It may be very irritating for the operator if it takes too long to build up the required hydraulic working pressure.

The return of the arm and the bucket makes heavy demands on the capacity of the oil pump feeding the hydraulic circuit. The two work cylinders must be moved almost from one extreme position to the other extreme position simultaneously, so that the pump must deliver nearly two whole cylinder volumes of oil.

From the publication DE 30 32 596 A1 various hydraulic circuits are known with a first and a second double-acting cylinder, each with a first and a second work chamber, and with a directional valve for each cylinder, which in an intial active position can lead the pressure medium into the first work chamber of the cylinder and lead the pressure medium from the second work chamber of the cylinder, and which in another active position can lead the pressure medium into the second work chamber of the cylinder and lead the pressure medium from the first work chamber of the cylinder. The pressure medium flows directed towards the cylinders are directed to the directional valves via non-return valves. The circuits include means of transferring pressure medium from the first work chamber of the first cylinder to the first work chamber of the second cylinder for moving the second cylinder simultaneously with the movement of the first cylinder resulting from the transfer of pressure medium.

The purpose of these known circuits is mainly to synchronise the movement of the bucket of a backhoe loader with the movement of the arm, for example so that the bucket is kept horizontal when the arm is swung up or down. This is achieved by series connecting the directional valves of the two cylinders with each other. When one cylinder is moved by an oil flow from the pump, the oil flow displaced by the movement from the opposite work chamber of the cylinder is transferred to the other cylinder, so that this is moved in synchronism with the first cylinder. The oil displaced from the second cylinder is lead to a tank. The circuit has the disadvantage, however, that in order to move one of the cylinders independently of the other it is required that the directional valve of the other cylinder must be kept in the neutral position. This switching of the directional valves can be very disturbing to the operator.

The present invention provides a hydraulic circuit where a pressure medium flow which is displaced from a cylinder is used for performing work in another cylinder in parallel with the other cylinder receiving pressure medium from a pump, and where the disadvantage of the known circuit is avoided.

By a circuit of the type stated this purpose is achieved by coupling the directional valves in parallel with each other to a pump line, that the first work chamber of the second cylinder is coupled via a non-return valve to a line section to which the directional valve of the first cylinder can divert the pressure medium from the first work chamber of the first cylinder, and that between this line section and a tank, a pressure-limiting valve is inserted, which admits flow to the tank when the pressure in the line section exceeds the pressure that activates the pressure-limiting valve.

In this manner the medium volume is exploited that is available in a passive, loaded cylinder, for performing work in another cylinder. Simultaneously with the pressure medium transfer from the passive cylinder, pressure medium can be supplied from the pump to the active cylinder.

When considering the example just described, viz. the arm cylinder and the bucket cylinder of a backhoe loader, the present invention can be exploited at the return to the digging position, in that during the return movement pressure medium is transferred to the bucket cylinder from the arm cylinder carrying the weight of the arm. Excess pressure medium, for example resulting from different volumes in the work chambers of the two cylinders, is pressed to the tank through the pressure-limiting valve.

If the pressure-limiting valve can be controlled as specified herein, one may choose freely between using the movement characteristic involved with the present invention in a given situation or not. There may be situations where it is preferred as quickly as possible to empty the passive, loaded work chamber of pressure medium, and it is then an advantage that it is possible to cancel the tank stop.

An advantageous solution will be as specified herein by letting the pressure-limiting valve be controlled by a control valve. The control valve provides for opening the pressure-limiting valve when it receives a release pressure from a load sensing line, which signals a load pressure elsewhere in the hydraulic circuit. Thereby the tank stop can be cancelled automatically. It is then possible, for example in valve blocks, to use a single pressure-limiting valve for blocking a tank line which is common to a group of valves, without the requirement that the tank flow from all valves shall be pressed to the tank through the pressure-limiting valve all the time.

As specified herein the control valve may also be coupled to open the pressure-limiting valve when the pressure in the pump line is a predetermined distance above the pressure that activates the pressure-limiting valve. The tank block is cancelled when the pump is heavily loaded for the purpose of reducing the pump loading.

In order to obtain a high pumping pressure while at the same time exploiting the working principle of the present invention, it is possible as specified herein to couple the control valve to receiving a blocking pressure from a load sensing line, signalling a load pressure existing elsewhere in the circuit, the coupling being arranged so that the blocking pressure prevents the opening of the pressure-limiting valve. The blocking pressure may especially originate from the first work chamber of the second cylinder, as specified herein.

Instead of using the pressure in the pump line as the releasing signal pressure for the control valve, it is also possible for this purpose to use the pressure in a load sensing line which shall control the pump pressure. The exemplary embodiments in this connection are specified herein.

With the restriction specified herein between the line section through which the pressure medium transfer between the cylinders takes place and the pressure-limiting valve, a pressure increase can be obtained in the line section even when the pressure-limiting valve is activated. This may be desirable for obtaining a high starting pressure in the movement sequence.

Through the line branch-off specified herein between the restriction and the pressure-limiting valve, the second work chamber of the first cylinder can be topped up with part of the pressure medium diverted from its first work chamber. This also contributes to reducing the required pumping capacity in the circuit.

For further explanation of the present invention, various exemplary embodiments are explained in the following with reference to the drawings attached.

FIGS. 1, 2, 3 and 4 show various hydraulic circuits according to the invention for a backhoe loader.

The hydraulic circuit according to FIG. 1 shows the arm cylinder 1 and the bucket cylinder 2 of a backhoe loader, each controlled by a directional valve 3, 4. The valves are mounted with other valves in a valve block 5 and are fed via a common pump line 6 from an oil pump 7. The oil pump output pressure is controlled in an ordinary manner known via load sensing (LS) channels 8 and double-acting two-way valves 9, which signal the maximum load pressure in the valve block to an LS pressure-limiting valve 10, which leads excess oil from the oil pump 7 to a tank 11. The valve block is generally designed with two common, through-going tanklines 12, 13 for all valves. The tank lines are connected with the tank 11.

The directional valves 3, 4 are designed with three positions and four ways (if the two tank lines are counted as one way). As drawn in FIG. 1 they are in a position where oil is transferred from a first work chamber 15 in the arm cylinder 1 to a first work chamber 16 in the bucket cylinder 2.

The oil transfer takes place in a situation where the arm is lifted, i.e. the piston rod 17 if the arm cylinder has been extended comparatively far (this is not quite correctly shown in the drawing, however). By contrast, the piston rod 18 of the bucket cylinder has been retracted far into the bucket cylinder, because the backhoe loader bucket has been emptied and is now tilted downwards. This is the initial position for the "return to dig" manoeuvre, where the arm shall be lowered and the bucket is tilted back up, so that the next bucketful material can be picked up.

When the arm is lowered, oil flows from the first work chamber 15 of the arm cylinder to the tank line 12 and is then transferred to the first work chamber 16 of the bucket cylinder through a non-return valve 19, which is connected with the A feed line 20 from the directional valve 4 of the bucket cylinder.

In order to maintain the required pressure to the oil transfer in the tank line 12, it is blocked (with a plug 21) between the tank 11 and the non-return valve 19. The plug 21 is placed in such a manner that the tank connection of the A side of cylinder 2 at the non-return valve 19 is blocked, whereas the B side of cylinder 2, leading to the other work chamber 26 in the bucket cylinder 2) has free passage to the tank. The tank line 13, which is connected to the tank line 12 via a connecting line 22, is also blocked with a plug 23. At the directional valve 3 the passage to the tank is blocked both for the A side, i.e. line 25, which leads to the first work chamber 15 of the arm cylinder, and for the B side, i.e. line 29, which leads to the second work chamber 27 of the arm cylinder. The valves in the valve block being closer to the pump 7 than the directional valve 4, have completely free passage to the tank, whereas the directional valve 3 and all other valves being farther from the pump than this valve has both passages to the tank blocked by the plugs 21 and 23.

In the blocked section of the lines 12, 22 and 13 the required pressure can therefore be generated for the transfer of oil from the chamber 15 to the chamber 16. The oil volume being available in chamber 15 is also used for topping up the other work chamber 27 of the arm cylinder via a non-return valve 30, which connects line 29 with the blocked-off section of line 13.

With the elements of the circuit described up to now it would be impossible to lead oil straight to the tank from the arm cylinder 1 or from components connected to valves situated farther to the right in the drawing, i.e. farther from the pump 7.

In order to allow for that possibility the tank line section 22 is connected to a pressure-limiting valve 40. The valve 40 is coupled so that it may open for passage when the pressure in the line section 22 exceeds a value predetermined by a spring load. In the example shown the valve opens when the pressure exceeds 25 bar. When the pressure unloading valve 40 opens, the line section 22 is connected via an external line 41 to the tank 11.

Therefore the pressure in the line sections 12, 22 and 13 could never exceed 25 bar (apart from pressure drops in the line system). In order to obtain a higher pressure in the transfer operation a restriction 42 has been inserted in the line section 12 between the pressure relief valve 40 and the line branch-off where the A side in the directional valve 3 is connected to the tank line 12. In the line section 43 between the plug 21 and the restriction 42 it is therefore possible to maintain a higher pressure than the pressure determined by the pressure-limiting valve 40, as long as there is an oil flow from the chamber 15.

With the described circuit it is possible to transfer oil from the chamber 15 to the chamber 16 while at the same time the chamber 16 receives oil from the pump 7 via directional valve 4, which is coupled to the pump line 6 via a non-return valve 44. In order to maintain the pressure in the pump line 6 a pressure regulating valve 47 has been inserted in the inlet 45 to the directional valve 3. The oil volume available in the chamber 15 is therefore exploited best possible when the piston rod 17 in the arm cylinder 1 returns, for topping up the opposite work chamber 27 of the arm cylinder and at the same time for moving the bucket cylinder piston rod 18.

It is desirable to cancel the tank block, i.e. to activate the pressure-limiting valve 40, when the piston rod 17 in the arm cylinder 1 shall be moved in the opposite direction, or when one of the valves placed to the right of the valve 3 on the drawing is to be activated. For this purpose a control valve 50 has been inserted in the circuit. The control valve 50 is a valve with three ways and two positions, which is coupled to activate the pressure limiting valve 40 when the control valve 50 receives a sufficiently high signal pressure via a connection to the LS signal system 8, 9. In this case the control valve is coupled to the LS line 8 between the directional valves 3 and 4 via a line 51. When the pressure in this line exceeds a value determined with a pre-tensioning spring in the control valve 50, the control valve changes to a position where the pressure in line 51 activates the pressure-limiting valve 40.

The circuit in FIG. 1 has the disadvantage that the tank block cannot be cancelled when the piston rod 18 in the bucket cylinder 2 shall be moved in the opposite direction.

Figure 2:
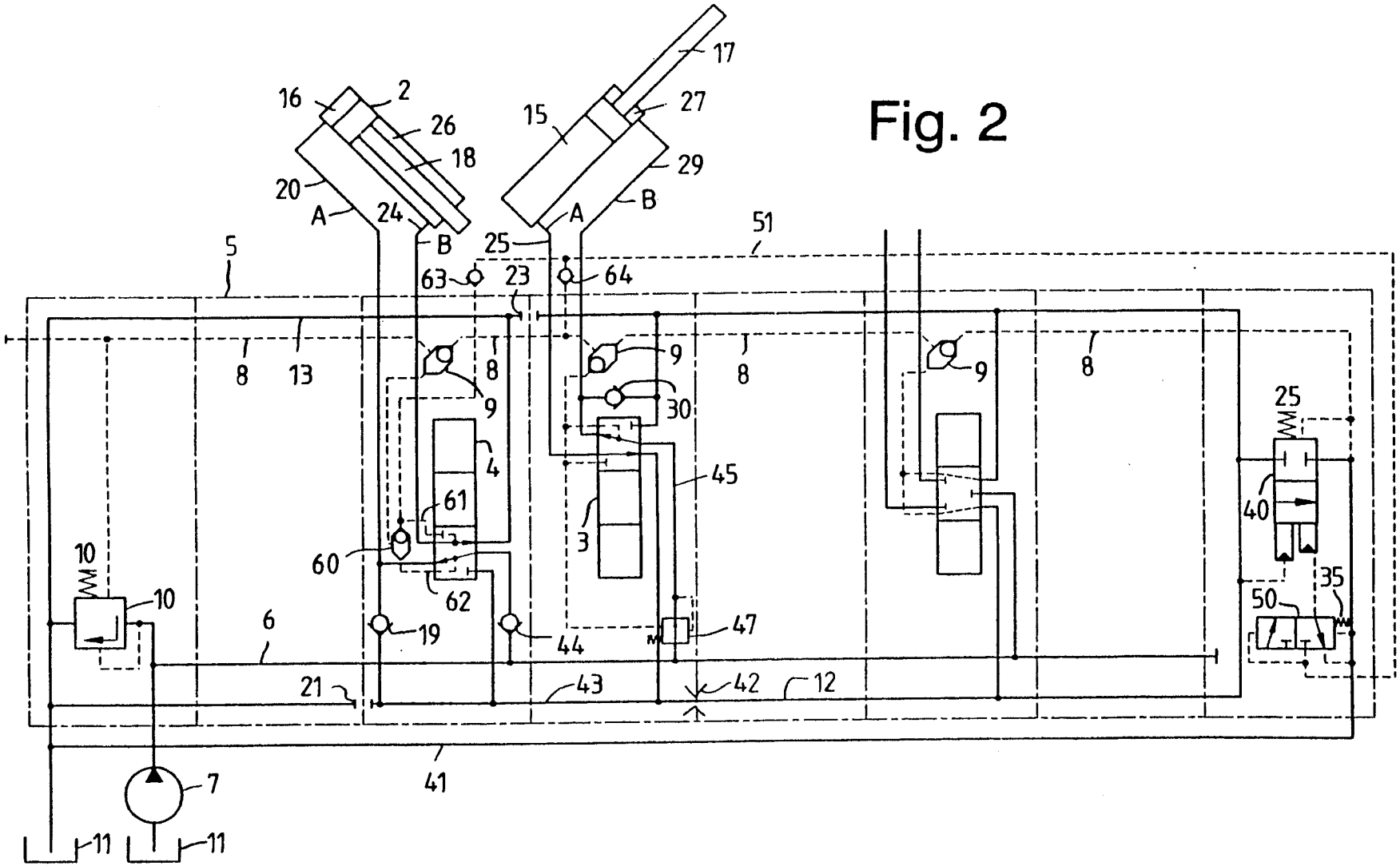

This disadvantage can be remedied as shown in FIG. 2, where in the LS line system at the directional valve 4 a double-acting non-return valve 60 is inserted between the relevant LS outlets 61 and 62 of the two channels (of A and B). The outlet of the non-return valve has been continued into the LS signal chain, while the LS outlet 61 of the B side is connected to the line 51 via a non-return valve 63, and a non-return valve 64 is inserted between the line 51 and its original connection point to the LS signal chain. When the load pressure is then highest on the B side at the directional valve 4, as it will be when the piston rod 18 shall be pushed into the cylinder 2, this will cause the pressure-limiting valve 40 to cancel the tank block via the line 51 and the control valve 50.

Figure 3:
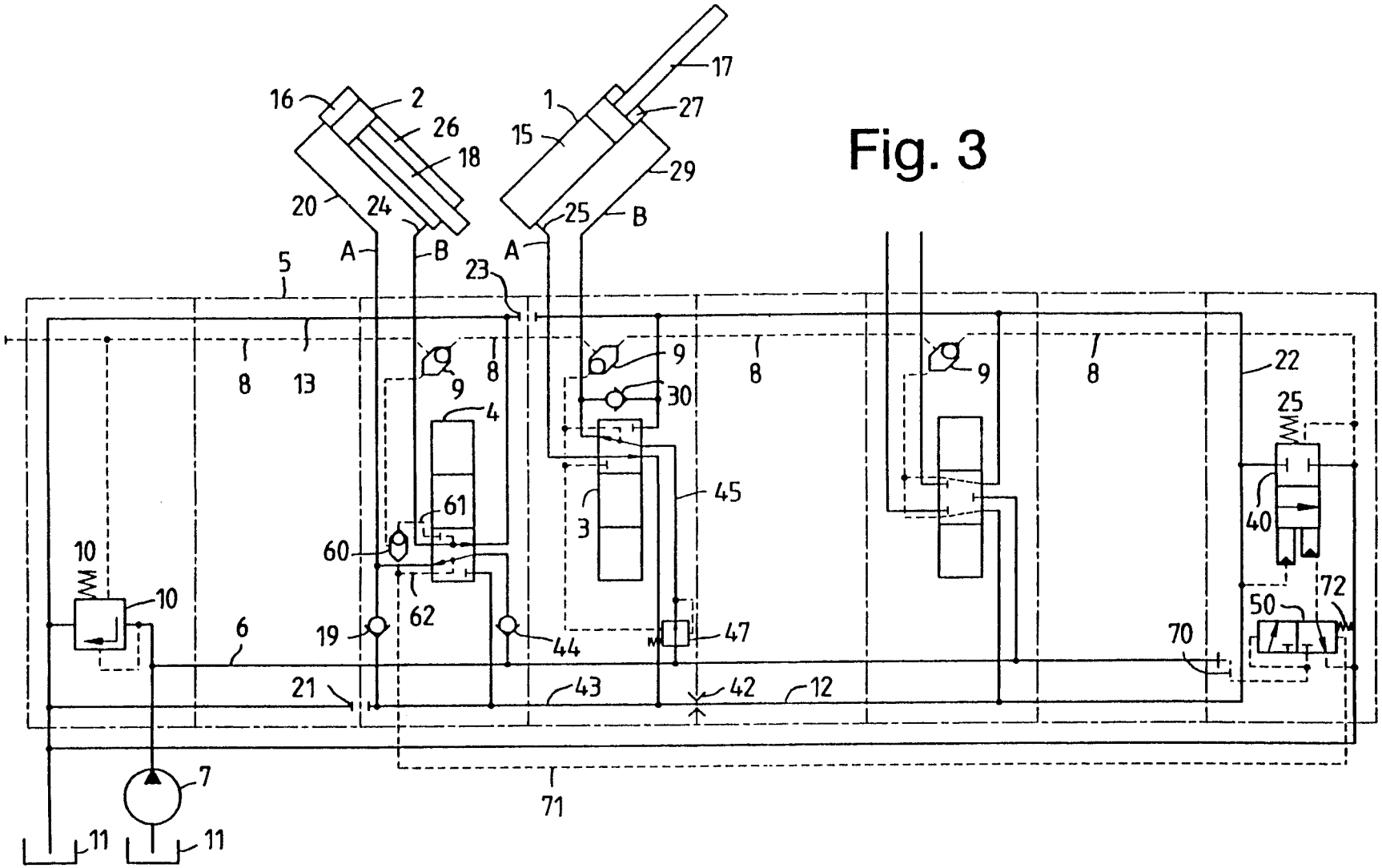

Another way to remedy this disadvantage is shown in FIG. 3. Here the control valve 50 is coupled so that it will always open when the pressure in pump line 6 exceeds its release value, because its control input 70 opposite the setting spring 72 is coupled to the pump line 6. Therefore the control valve 50 activates the pressure-limiting valve 40 hen the pump pressure is high enough, whereby the tank block is cancelled regardless of where in the valve block the high pressure is needed, i.e. regardless of which valve has been activated.

In order to suppress this effect when the oil transfer shall take place between the chambers 15 and 16, there is in this embodiment coupled also a double-acting non-return valve 60 between the two LS outlets 61 and 62 at the directional valve 4. The outlet from the non-return valve is carried into the LS signal chain as in FIG. 2, while in this case the LS signal of the A side on outlet 2 has been carried to the control valve 50 via a line 71. The line 71 is connected to the spring room in the control valve 50, so that the LS pressure on the A side 62 in the directional valve 4 blocks for activation of the pressure-limiting valve 40. Therefore the tank block cannot be cancelled when an oil transfer shall take place from chamber 15 to chamber 16, and that is exactly what is desired.

Figure 4:
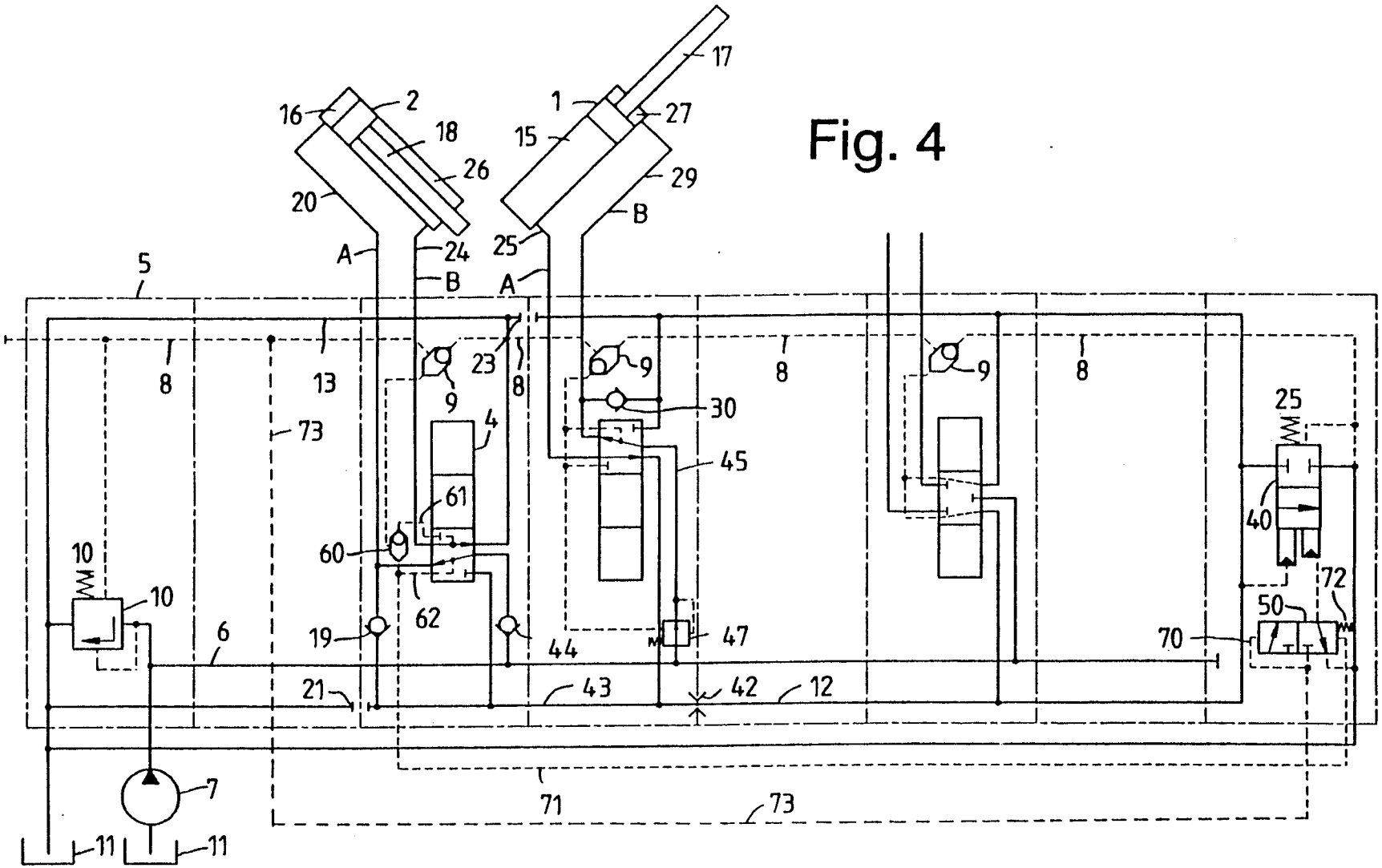

An alternative to the diagram shown in FIG. 3 appears in FIG. 4. Here the control input 70 of the control valve 50 is not connected to the pump line 6, but to the pump side of the LS signal chain (8,9) via a line 73. Otherwise the diagram is identical to FIG. 3. Here the advantage is that the setting spring 72 of the control valve 50 may be weaker than in FIG. 3, because the pressure in the LS line chain will be lower than the pump pressure. On the other hand the solution has the disadvantage that it introduces a certain additional leakage in the LS line network.

We claim:

1. A hydraulic circuit for apparatus for a backhoe loader of the type having a swingable arm and a digging bucket pivotally mounted at the outer end of the swingable arm, comprising, double acting swingable arm and digging bucket cylinders each having first and second work chambers connectable respectively to said swingable arm and said digging bucket, pump means for generating a pressure medium, a tank, first and second directional valves connected respectively to said swingable arm cylinder and said digging bucket cylinder, said cylinders having respective return positions assumed substantially simultaneously when said first directional valve effects moving said swingable arm to a lower start position and said second directional valve assists in effecting the pivoting of said digging bucket from an upside down emptying position to a starting right-side up digging position, circuit means for facilitating the movement of said swingable arm cylinder to its said return position when said first directional valve directs pressure medium from said pump means to said first work chamber of said swingable arm cylinder and from said second work chamber of said swingable arm cylinder to said first work chamber of said digging bucket cylinder, and circuit means for facilitating the movement of said digging bucket cylinder to its said return position when said second directional valve directs pressure medium from said pump means to said first work chamber of said digging bucket cylinder and from said second work chamber of said digging bucket cylinder to said tank.

2. A hydraulic circuit according to claim 1 including a line section between said second work chamber of said digging bucket cylinder and said tank and a pressure limiting valve for said line section which is activated at a predetermined pressure sufficient to facilitate simultaneous movement of said cylinders.

3. A hydraulic circuit according to claim 2 including control valve means for controlling said pressure limiting valve for opening said line section to said tank.

4. A hydraulic circuit according to claim 3 including a load sensing line connecting said control valve means to a desired point in said circuit to effect opening of said pressure limiting valve via said control valve means when the pressure at said desired point is a predetermined level higher than said predetermined pressure.

5. A hydraulic circuit according to claim 4 including a second load sensing line connecting said control valve means to a second desired point in said circuit to prevent opening of said pressure limiting valve by a blocking pressure being transmitted from said second desired point to said control valve means.

6. A hydraulic circuit according to claim 5 wherein said second desired point has fluid communication with said first work chamber of said second double-acting cylinder.

7. A hydraulic circuit according to claim 5 including a third load sensing line connecting said control valve means to a third desired point in said circuit which is at the outlet of said pump means to effect opening of said pressure limiting valve via said control valve means when the pressure generated by said pump is at a predetermined level higher than said predetermined pressure.

* * * * *